United States Patent [19]

Schaufele et al.

[11] 4,027,191

[45] May 31, 1977

[54] PHOSPHOR GEOMETRY FOR COLOR DISPLAYS FROM A MULTIPLE GASEOUS DISCHARGE DISPLAY/MEMORY PANEL

[76] Inventors: Robert F. Schaufele, 1562 Forest Hills Drive, Okemos, Mich. 48864; Felix H. Brown, 1968 Rutgers Circle, East Lansing, Mich. 48823

[22] Filed: Dec. 16, 1970

[21] Appl. No.: 98,846

[52] U.S. Cl. ..... 313/487; 313/220; 313/224; 313/493

[51] Int. Cl.[2] ..... H01J 61/16; H01J 61/30; H01J 61/44

[58] Field of Search ..... 313/108 R, 108 A, 108 B, 313/109, 109.5, 210, 220, 225, 224, 485, 493, 486, 487; 315/169 TV

[56] References Cited

UNITED STATES PATENTS

| | | | |
|---|---|---|---|
| 2,207,174 | 7/1940 | Jenkins | 313/109 |
| 2,622,221 | 12/1952 | Beese | 313/109 |
| 2,644,113 | 6/1953 | Etzkorn | 313/108 R X |
| 3,374,381 | 3/1968 | Albinak et al. | 313/108 R |
| 3,504,819 | 4/1970 | Veres | 313/109 X |
| 3,509,407 | 4/1970 | Cullis, Jr. | 313/220 X |
| 3,559,190 | 1/1971 | Bitzer et al. | 315/169 TV |
| 3,562,737 | 2/1971 | Wiederhorn et al. | 313/108 R X |

*Primary Examiner*—Palmer C. Demeo

[57] ABSTRACT

There is disclosed a multiple gaseous discharge display/memory panel having an electrical memory and capable of producing a visual color display, the panel being characterized by an ionizable gaseous medium in a gas chamber formed by a pair of opposed dielectric material charge storage members which are respectively backed by a series of parallel-like conductor (electrode) members, the conductor members behind each dielectric material member being transversely oriented with respect to the conductor members behind the opposing dielectric material member so as to define a plurality of discrete discharge volumes each of which constitutes a discharge unit, at least one dielectric material member containing a photoluminescent phosphor geometrically adjacent to at least one discharge unit, such that the phosphor is excited with ultraviolet radiation emitted from the gaseous discharge of such unit and such that the UV excited phosphor emits visible light of a brightness and intensity sufficient for visual display. In one preferred embodiment, the UV has a wavelength of about 500 to about 2500 angstrom units.

31 Claims, 16 Drawing Figures

Figure 1:
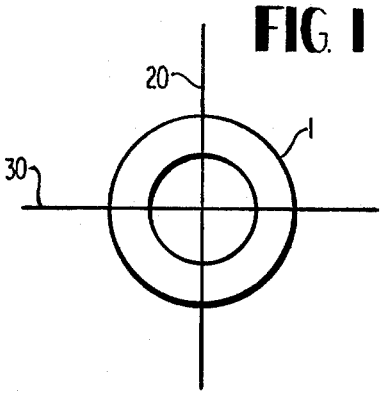

FIG. 9
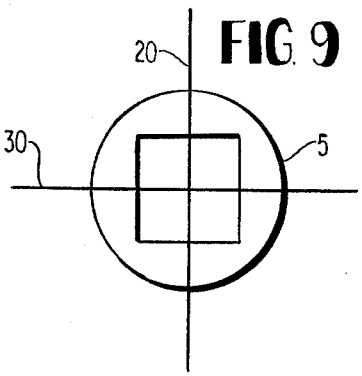
FIG. 10
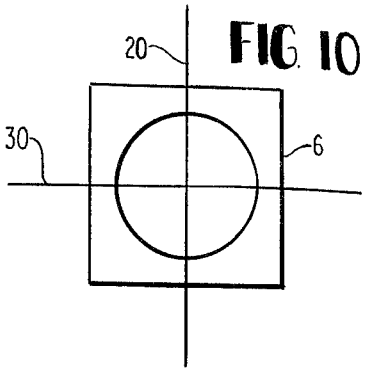
FIG 11
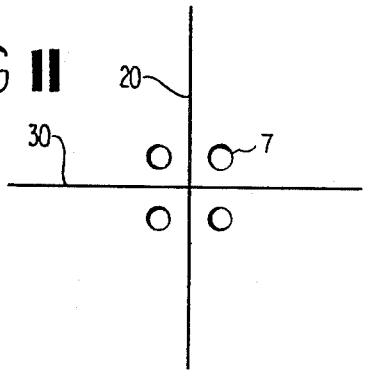
FIG. 12
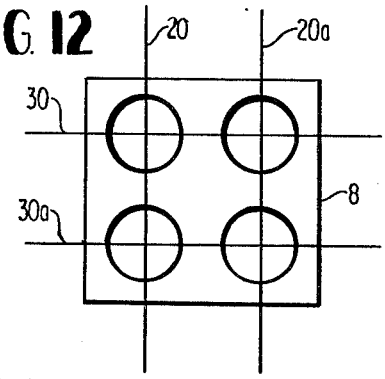
FIG. 13
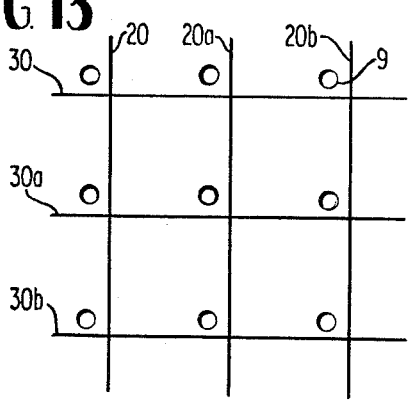
FIG 14
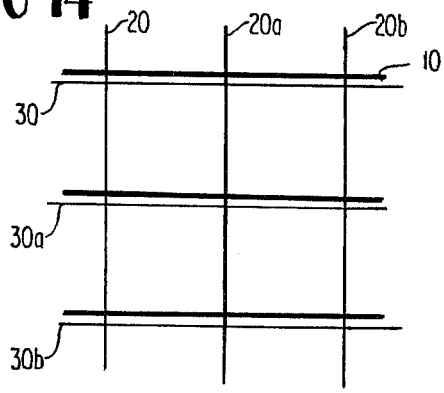
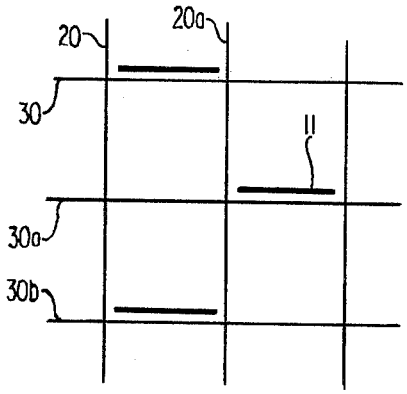
FIG 15
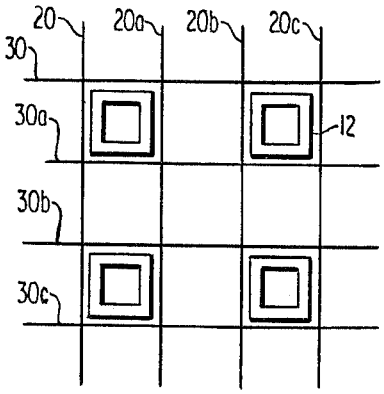
FIG 16

PHOSPHOR GEOMETRY FOR COLOR DISPLAYS FROM A MULTIPLE GASEOUS DISCHARGE DISPLAY/MEMORY PANEL

THE INVENTION

This invention relates to novel multiple gas discharge display/memory panels which have an electrical memory and which are capable of producing a visual color display including the representation of data such as numerals, letters, television display, radar displays, binary words, etc. More particularly, this invention relates to multiple gas discharge devices capable of producing a visual color display in a color other than that characteristic of the color exhibited by the particular gaseous medium utilized in the device.

Multiple gas discharge display and/or memory panels of the type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member being transversely oriented to define a plurality of discrete discharge volumes, each of which constitutes a discharge unit. In some prior art panels the discharge units are additionally defined by surrounding or confining physical structure such as by cells or apertures in perforated glass plates and the like so as to be physically isolated relative to other units. In either case, with or without the confining physical structure, charges (electrons, ions) produced upon ionization of the gas of a selected discharge unit, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting am electrical memory.

Thus, the dielectric layers prevent the passage of any conductive curren. from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on an opposing elemental or discrete dielectric surface area on alternate half cycles to constitute an electrical memory.

An example of a panel structure containing non-physically isolated or open discharge units is disclosed in U.S. Pat. No. 3,499,167 issued to Theodore C. Baker et al.

An example of a panel containing physically isolated units is disclosed in the article by D. L. Bitzer and H. G. Slottow entitled "The Plasma Display Panel—A Digitally Addressable Display With Inherent Memory", Proceeding of the Fall Joint Computer Conference, IEEE, San Francisco, Calif., November 1966, pages 541–547.

In the operation of the panel, a continuous volume of ionizable gas is confined between a pair of dielectric surfaces backed by conductor arrays forming matrix elements. The cross conductor arrays may be orthogonally related (but any other configuration of conductor arrays may be used) to define a plurality of opposed pairs of charge storage areas on the surfaces of the dielectric bounding or confining the gas. Thus, for a conductor matrix having H rows and C columns the number of elemental discharge volumes will be the product H × C and the number of elemental or discrete areas will be twice the number of elemental discharge volumes.

The gas may be one which produces light (if visual display is an objective) and a copious supply of charges (ions and electrons) during discharge. In an open cell Baker, et al. type panel, the gas pressure and the electric field are sufficient to laterally confine charges generated on discharge within elemental or discrete volumes of gas between opposed pairs of elemental or discrete dielectric areas within the perimeter of such areas, especially in a panel containing non-isolated units.

As described in the Baker et al. patent, the space between the dielectric surfaces occupied by the gas is such as to permit photons generated on discharge in a selected discrete or elemental volume of gas to pass freely through the gas space and strike surface areas of dielectric remote from the selected discrete volumes, such remote, photon struck dielectric surface areas thereby emitting electrons so as to condition other and more remote elemental volumes for discharges at a uniformly applied potential.

With respect to the memory function of a given discharge panel, the allowable distance or spacing between the dielectric surfaces depends, among other things, on the frequency of the alternating current supply, the distance typically being greater for lower frequencies.

While the prior art does disclose gaseous discharge devices having externally positioned electrodes for initiating a gaseous discharge, sometimes called "electrodeless discharges," such prior art devices utilize frequencies and spacings or discharge volumes and operating pressures such that although discharges are initiated in the gaseous medium, such discharges are ineffective or not utilized for charge generation and storage in the manner of the present invention.

The term "memory margin" is defined herein as $$M.M. = \frac{V_f - V_s}{V_s}$$

where $V_f$ is the magnitude of the applied voltage at which a discharge is initiated in a discrete conditioned (as explained in the aforementioned Baker, et al. patent) volume of gas defined by common areas of overlapping conductors and $V_s$ is the magnitude of the minimum applied periodic alternating voltage sufficient to sustain discharges once initiated. It will be understood that basic electrical phenomena utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, one discharge for each half cycle of applied alternating sustaining voltage, once the elemental gas volume has been fired, to maintain alternate storing of charges at pairs of opposed discrete areas on the dielectric surfaces.

In accordance with the practice of this invention, there is provided a multiple gaseous discharge display/memory panel capable of producing a visual color display, the panel having at least one dielectric material charge storage member containing a photoluminescent phosphor geometrically adjacent to at least one discharge unit, such that the phosphor is excited with ultraviolet radiation emitted from the gaseous discharge of such unit and such that the phosphor emits visible light of a brightness and intensity sufficient for visual display.

In one preferred embodiment hereof, the photoluminescent phosphor is excited with vacuum ultraviolet radiation of about 500 to about 2500 angstrom units, with a more preferred range of about 750 to about 2000 angstrom units.

As used herein, color is broadly intended to include all phosphor electromagnetic output and emission in the visible range including various combinations thereof such as white light. Color is also intended as used in the sense of color television.

The term photoluminescent phosphor includes quite generally all solid and liquid, inorganic and organic materials which are able to convert absorbed energy in the form of quanta of ultraviolet radiation, especially UV of about 500 to about 2500 angstrom units, into visible light.

Typical photoluminescent phosphors contemplated include not by way of limitation both activated and non-activated compounds, e.g. the sulfides such as zinc sulfides, zinc-cadmium sulfides, zinc-sulfo-selenides; the silicates such as zinc silicates, zinc beryllo-silicate, Mg silicates; the tungstates such as calcium tungstates, magnesium tungstates; the phosphates, borates, and arsenates such as calcium phosphates, cadmium borates, zinc borates, magnesium arsenates; and the oxides and halides such as self-activated zinc oxide, magnesium fluorides, magnesium fluorogermanate. Typical activators include not by way of limitation Mn, Eu, Ce, Pb, etc.

The phosphor is applied to and/or combined with the dielectric by any suitable manner or means such that the phosphor can be excited by ultraviolet radiation emitted from the gaseous discharge(s) of the panel. Typically the phosphor is applied directly to the dielectric surface so as to be directly exposed (such as by direct contact) to the gaseous medium and UV radiation emitted by the discharge units. If the phosphor is beneath the dielectric surface and is not directly exposed to the gaseous medium or other source of the UV radiation, then the dielectric material must be transparent to such UV radiation so as to permit excitation of the phosphor. Thus one further embodiment of this invention comprises overcoating the photoluminescent phosphor with a dielectric material transparent to the prescribed UV.

Each phosphor is applied to the dielectric surface (or sub-surface) by any convenient means including not by way of limitation vapor deposition; vacuum deposition; chemical vapor deposition; wet spraying or settling upon the dielectric a mixture or solution of the phosphor suspended or dissolved in a liquid followed by evaporation of the liquid (and fusion of the phosphor if needed); silk screening; dry spraying of the phosphor upon the dielectric; electron beam evaporation; plasma flame and/or arc spraying and/or deposition; and sputtering target techniques.

The phosphor is applied to the dielectric in an amount sufficient for visual display, typically as a very thin film or layer of about 100 angstrom units up to about 10 microns or more.

In one preferred embodiment hereof, the photoluminescent phosphor material is deposited, with or without a binder, directly onto a portion of the gas exposed charge storage surface of the dielectric so that the phosphor can be directly excited by ultraviolet radiation emitted from the ionized gaseous medium during the operation of the panel; that is, ultraviolet radiation from the gaseous discharge units, preferably UV of about 500 to about 2500 angstrom units.

Another method of application comprises mixing the phosphor with a commercial photobinder, spraying the mixture onto the glass substrate, drying the sprayed mixture, exposing the photobinder to radiation so as to obtain a desired pattern, and then developing, e.g. with heat or a commercial developer.

Other methods of application could be any of those typically used in color cathode ray tubes, e.g. such as a two-step process where a clear photobinder is applied and the dried film is exposed and developed. A phosphor slurry is then applied, dried and redeveloped. This method should result in sharper definition since the exposure is made without the presence of light scattering crystals.

Another method comprises a dusting process where the dry phosphor is dusted on a sticky photobinder. Another method comprises settling the phosphor, drying, coating with a photobinder, exposing and developing.

Another embodiment of this invention would be the use of luminescent glass to replace the phosphor and also the dielectric glass which is used to separate the electrodes. Such embodiment includes embedding the luminescent glass directly into the dielectric surface.

It is further contemplated in the practice hereof that two or more phosphors may be combined so as to produce a multicolor display, each phoshpor being excited by the same or different source. In such embodiment, the radiation from one phosphor may be used to excite another phosphor.

As an extension of this embodiment it is possible to produce multicolor displays by the use of two or more phosphors with a different colored phosphor at adjacent electrode intersections. This allows control of the discharge so as to excite only the color desired. In this manner, one could produce red characters on a green background for a more striking visual display.

Another extension is the use of three color dots, as commonly used in cathode ray tubes, to obtain multicolor displays. To get true color pictures a means of controlling the intensity of the light from each color is necessary. Possible ways of doing this are varying the voltage applied to the discharge exciting a particular color; varying duration of discharge; use of multilayers of glass and phosphor, possibly with transparent electrodes; and addressing the various layers independently.

As noted hereinbefore, the practice of this invention comprises exciting the photoluminescent phosphor with ultraviolet radiation emitted from the ionized gaseous medium of a gaseous discharge unit, e.g. adjacent to the phosphor. It is contemplated using any gaseous medium which will emit (upon panel discharge) ultraviolet radiation sufficient to excite the photoluminescent phosphor.

In one highly preferred embodiment hereof, the UV emitting gaseous medium is selected from the rare gases of helium, neon, argon, krypton, xenon, and mixtures thereof. In the practice of such embodiment, it has been discovered that the phosphor exciting effectiveness of such rare gases increases with atomic weight, e.g. from neon to argon to krypton to xenon. With krypton and xenon, practically all of the visible light emitted from the panel comes from the excited phosphors, e.g. relative to color emitted by the gaseous medium during the gaseous discharge.

It is further contemplated that other gases may be useful in the practice of this invention including not by way of limitation nitrogen, hydrogen, oxygen, carbon dioxide, carbon monoxide, etc., as well as mixtures thereof.

The operation of a gaseous discharge display/memory panel comprises consideration of many operating parameters. In the practice of this invention, two important parameters are the gaseous medium pressure and the frequency of the A.C. supply.

The gaseous medium must be at a pressure sufficient to give a panel memory margin, the exact gas pressure being a function of the particular gaseous medium and other parameters of the system. For example, a pressure of about 50 Torr to about 400 Torr is contemplated for 100% xenon. For mixtures of neon-argon or neon-argon-xenon, pressures up to about 800 Torr may be utilized. Thus for rare gases and mixtures thereof, an overall pressure of about 50 Torr to about 800 Torr is contemplated.

The frequency of the A.C. supply must be sufficient for both memory margin and display purposes. Typically the higher the frequency, the greater the average light output. However, for optimum memory margin the frequency ranges from about 25 kilohertz to about 300 kilohertz depending upon other parameters, e.g. pressure and wave shape.

In the prior art the color of a display from a gaseous discharge device has been limited to a color characteristic of the particular gas in use, for example red with neon or blue with xenon. The present invention allows other colors to be obtained from the discharge of a particular gas. For example a display using a xenon discharge can be made to appear red, green, blue or almost any other color. This invention also shows that desirable electrical properties, such as memory margin, can be maintained.

In accordance with the broad practice of this invention, it is contemplated applying the phosphor to the dielectric (surface or sub-surface) in any suitable geometric shape, pattern, or configuration, symmetrical or asymmetrical, providing the phosphor is excluded from the electrodes intersection of each discharge unit or the panel while being sufficiently adjacent to at least one discharge unit so as to be excited by UV emitted from the gaseous discharge of such unit.

Typical geometric phosphor shapes contemplated include those which surround or partially surround the electrode intersection in a continuous or discontinuous, symmetrical or asymmetrical, fashion such as rings or donuts, squares, diamonds, rectangles, triangeles, etc.

Reference is made to the drawings and FIGS. 1 to 16 thereon which illusrate some of the various phosphor geometric arrangements and specific embodiments of this invention.

In FIG. 1, there is shown a continuous phosphor donut or ring 1 surrounding the intersection of electrodes 20 and 30.

Figure 2:
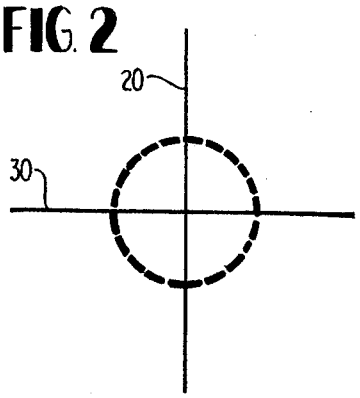
Figure 3:
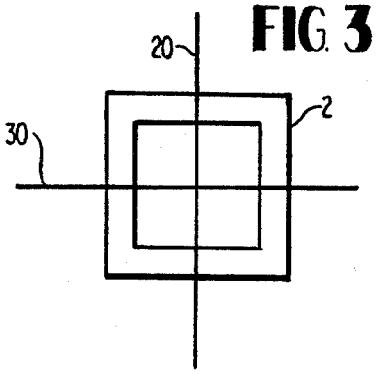

In FIG. 2, there is shown a discontinuous or broken phosphor donut or ring 1*a* surrounding the intersection of electrodes 20 and 30. Although the ring 1*a* is made up of discontinuous discrete lines, it could just as well be comprised of a series of finite phosphor dots, e.g. as illustrated in other figures hereinafter.

In each of the FIGS. 3, 5, 7, 9, and 10, there is shown a continuous phosphor geometric embodiment representing a possible modification of the phosphor ring of FIG. 1.

Figure 4:
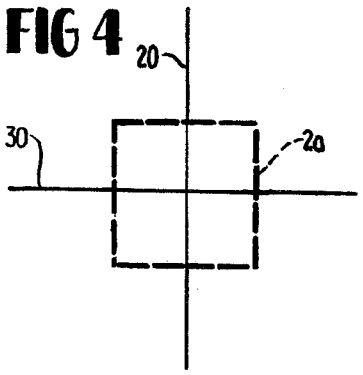
Figure 5:
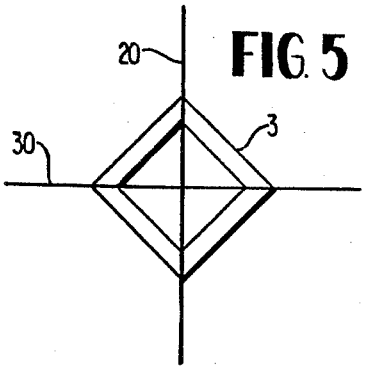
Figure 6:
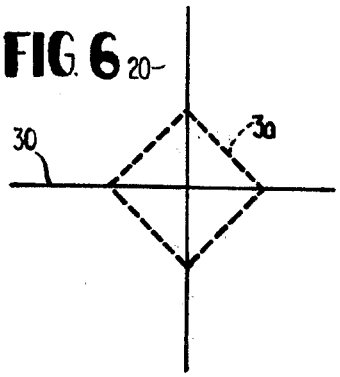
Figure 7:
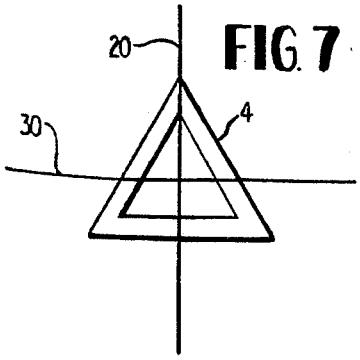
Figure 8:
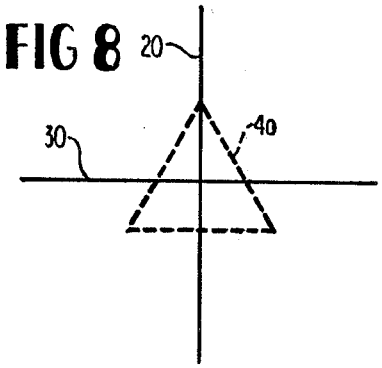

In each of the FIGS. 4, 6, and 8, there is shown a discontinuous phosphor geometric embodiment representing a possible modification of the phosphor ring of FIG. 2. The discrete lines comprising each embodiment could readily be replaced by phosphor dots.

In FIGS. 11 and 13, there is shown a discontinuous phosphor pattern comprised of phosphor dots 7 and 9.

In FIG. 12, there is shown a continuous phosphor layer 8 which covers the entire panel dielectric surface with openings therein at the intersections of electrodes 20, 20*a*, 30, and 30*a*.

In FIGS. 14, 15, and 16, there are shown further phosphor geometric arrangement embodiments.

Although specific phosphor geometric embodiments have been described hereinbefore and illustrated (FIGS. 1 to 16), it will be apparent to those skilled in the art that other phosphor embodiments are possible and within the overall scope of this invention. Likewise, it is contemplated that different geometric arrangements may be used within the same gaseous discharge panel.

We claim:

1. In a gaseous discharge display/memory device comprising an ionizable gaseous medium in a gas chamber formed by a pair of opposed dielectric material charge storage members backed by electrode members, the electrode members behind each dielectric material surface being transversely oriented with respect to the electrode members behind the opposing dielectric material surface so as to provide a plurality of electrode intersections, each defining a discharge unit, said units being in open ultraviolet photonic communication through said gas chamber, the improvement wherein at least one of said dielectric members includes photoluminescent phosphor means sensitive to and excited by ultraviolet radiation, said phosphor means being located between said electrode members and said gaseous medium and being excluded from the intersection of electrodes at each discharge unit while being sufficiently adjacent to said intersection so as to be excited by ultraviolet radiation emitted from the gaseous discharge of such unit and emit visible light of a brightness and intensity sufficient for visual display.

2. The invention of claim 1 wherein the photoluminescent phosphor means comprises a phosphor coating on said dielectric material surface in direct contact with said gaseous medium which is sensitive to and excited by ultraviolet radiation of about 500 to about 2500 angstrom units.

3. The invention of claim 1 wherein the ionizable gaseous medium is a rare gas selected from helium, neon, argon, krypton, xenon, and mixtures thereof.

4. The invention of claim 1 wherein the gaseous medium is xenon.

5. The invention of claim 4 wherein the photoluminescent phosphor means is capable of excitation with ultraviolet radiation of about 750 to about 2000 angstrom units.

6. In the manufacture of a gaseous discharge display/memory device characterized by an ionizable gaseous medium in a gas chamber formed by a pair of dielectric material members having opposed charge storage surfaces, which dielectric material members are respectively backed by a series of parallel-like electrode members, the electrode members behind each dielectric material member being transversely oriented with respect to the electrode members behind the opposing dielectric material member so as to provide a plurality of electrode intersections with discrete discharge volumes, each of which constitutes a discharge unit, said units being in open photonic communication with each other, and wherein the gas is selectively ionized within each discharge unit by operating voltages selectively applied to the transversely oriented electrode members, the improvement which comprises applying at least one photoluminescent phosphor to at least one dielectric member in a geometric configuration such that the phosphor is located between said electrode members and said gaseous medium and is excluded from the intersection of electrodes at each discharge unit while being sufficiently adjacent to at least one intersection so as to be excited by ultraviolet radiation emitted from the gaseous discharge of such unit whereby visible light of a brightness and intensity sufficient for visual display is emitted.

7. The invention of claim 6 wherein the gaseous medium is a rare gas selected from helium, neon, argon, krypton, xenon, and mixtures thereof.

8. The invention of claim 6 wherein the geometric configuration of the phosphor is symmetrical relative to the electrodes intersection of the adjacent discharge unit.

9. The invention of claim 6 wherein the geometric configuration of the phosphor is asymmetrical relative to the electrodes intersection of the adjacent discharge unit.

10. The invention of claim 6 wherein the phosphor is coated on the surface of said dielectric material in direct contact with said gaseous medium and is excited with ultraviolet radiation of about 500 to about 2500 angstrom units.

11. In a gaseous discharge display/memory device comprising an ionizable gaseous medium in a gas chamber formed by a pair of opposed dielectric material charge storage members backed by electrode members, the electrode members behind each dielectric material surface being transversely oriented with respect to the electrode members behind the opposing dielectric material surface so as to provide a plurality of electrode intersections, each defining a discharge unit, the improvement wherein at least one of said dielectric members includes photoluminescent phosphor means sensitive to and excited by ultraviolet radiation, said phosphor means being located between said electrode members and said gaseous medium, being excluded from the intersection of electrodes at each discharge unit, and being arranged in a closed geometric configuration about the electrode intersection of each discharge unit while being sufficiently adjacent to said intersection so as to be excited by ultraviolet radiation emitted from the gaseous discharge of such unit and emit visible light of a brightness and intensity sufficient for visual display.

12. The invention of claim 11 wherein said photoluminescent phosphor means comprises a plurality of phosphor elements spaced from each other about each electrode intersection forming said closed geometric configuration.

13. The invention of claim 11 wherein the geometric configuration of said photoluminescent phosphor means is annular.

14. The invention of claim 11 wherein the geometric configuration of said photoluminescent phosphor means is rectangular.

15. The invention of claim 11 wherein the geometric configuration of said photoluminescent phosphor means is triangular.

16. In a gaseous discharge display/memory device comprising an ionizable gaseous medium in a gas chamber formed by a pair of opposed dielectric material charge storage members backed by electrode members, the electrode members behind each dielectric material surface being transversely oriented with respect to the electrode members behind the opposing dielectric material surface so as to provide a plurality of electrode intersections, each defining a discharge unit, the improvement wherein at least one of said dielectric members includes photoluminescent phosphor means sensitive to and excited by ultraviolet radiation, said phosphor means being located between said electrode members and said gaseous medium and comprising a substantially continuous layer exclusive of the areas at said electrode intersections of said discharge units while being sufficiently adjacent to each of said intersections so as to be excited by ultraviolet radiation emitted from the gaseous discharge of each unit and emit visible light of a brightness and intensity sufficient for visual display.

17. In a gaseous discharge display/memory device comprising an ionizable gaseous medium in a gas chamber formed by a pair of opposed dielectric material charge storage members backed by electrode members, the electrode members behind each dielectric material surface being transversely oriented with respect to the electrode members behind the opposing dielectric material surface so as to provide a plurality of electrode intersections, each defining a discharge unit, the improvement wherein at least one of said dielectric members includes photoluminescent phosphor means sensitive to and excited by ultraviolet radiation, said phosphor means being located between said electrode members and said gaseous medium and comprising a phosphor dot spaced from each electrode intersection while being sufficiently adjacent to said intersection so as to be excited by ultraviolet radiation emitted from the gaseous discharge of such unit and emit visible light of a brightness and intensity sufficient for visual display.

18. In a gaseous discharge display/memory device comprising an ionizable gaseous medium in a gas chamber formed by a pair of opposed dielectric material charge storage members backed by electrode members, the electrode members behind each dielectric material surface being transversely oriented with respect to the electrode members behind the opposing dielectric material surface so as to provide a plurality of electrode intersections, each defining a discharge unit, the improvement wherein at least one of said dielectric members includes photoluminescent phosphor means sensitive to and excited by ultraviolet radiation, said phosphor means being located between said electrode members and said gaseous medium, being arranged in at least one linear configuration extending adjacent a plurality of said electrode intersections and being excluded from the intersection of electrodes at each discharge unit while being sufficiently adjacent to said intersection so as to be excited by ultraviolet radiation emitted from the gaseous discharge of such unit and emit visible light of a brightness and intensity sufficient for visual display.

19. In a gaseous discharge display/memory device comprising an ionizable gaseous medium in a gas chamber formed by a pair of opposed dielectric material charge storage members backed by electrode members, the electrode members behind each dielectric material surface being transversely oriented with respect to the electrode members behind the opposing dielectric material surface so as to provide a plurality of electrode intersections, each defining a discharge unit, the improvement wherein at least one of said dielectric members includes photoluminescent phosphor means sensitive to and excited by ultraviolet radiation, said phosphor means being located between said electrode members and said gaseous medium, being arranged in at least one closed geometric configuration between adjacent electrode intersections and being excluded from the intersection of electrodes at each discharge unit while being sufficiently adjacent to said intersection so as to be excited by ultraviolet radiation emitted from the gaseous discharge of such unit and emit visible light of a brightness and intensity sufficient for visual display.

20. A gas discharge display memory device comprising, in combination, a pair of spaced-apart non-conductive support members, a pair of conductor arrays arranged one on each of the confronting surfaces of said support members, the arrays being in transverse relative orientation so as to provide a series of cross-points therebetween each defining a discharge unit, a thin dielectric material coating on the confronting surfaces of each of the support members and conductor arrays for storing charges and defining therebetween a sealed gas chamber with said discharge units in open ultraviolet photonic communication with each other, at least one of said dielectric material coatings including photoluminescent phospor means sensitive to and excited by ultraviolet radiation located on the surface of said dielectric material in direct contact with said gaseous medium, said phosphor means being excluded from the cross-point of each of said discharge units while being sufficiently adjacent to at least one cross-point so as to be excited by ultraviolet radiation emitted by the gaseous discharge of such unit, whereby visible light of a brightness and intensity sufficient for visual display will be emitted by said phosphor means at each discharge unit where a gaseous discharge occurs.

21. The invention of claim 20 wherein the photoluminescent phosphor means is arranged in a closed geometric configuration about the cross-point of each discharge unit.

22. The invention of claim 21 wherein said photoluminescent phosphor means comprises a plurality of phosphor elements spaced from each other about each cross-point forming said closed geometric configuration.

23. The invention of claim 21 wherein the geometric configuration of said photoluminescent phosphor means is annular.

24. The invention of claim 21 wherein the geometric configuration of said phosphor means is rectangular.

25. The invention of claim 21 wherein the geometric configuration of said phosphor means is triangular.

26. The invention of claim 21 wherein said photoluminescent phosphor means comprises a substantially continuous layer exclusive of the areas at said cross-points of said discharge units.

27. The invention of claim 20 wherein said photoluminescent phosphor means comprises a phosphor dot spaced from each cross-point.

28. The invention of claim 20 wherein said photoluminescent phosphor means is arranged in at least one linear configuration extending adjacent a plurality of said cross-points.

29. The invention of claim 20 wherein said photoluminescent phosphor means is arranged in at least one closed geometric configuration between adjacent discharge units.

30. In a gaseous discharge display/memory device adapted for multi-color displays and comprising an ionizable gaseous medium in a gas chamber formed by a pair of opposed dielectric material charge storage members backed by electrode members, the electrode members behind each dielectric material surface being transversely oriented with respect to the electrode members behind the opposing dielectric material surface so as to provide a plurality of electrode intersections, each defining a discharge unit, the improvement wherein at least one dielectric member includes a plurality of photoluminescent phosphors sensitive to and excited by ultraviolet radiation, said plurality including phosphors of at least two different compositions, each upon excitation emitting a different color, said phosphors being located between said electrode members and said gaseous medium and being excluded from the intersection of electrodes at each discharge unit while being sufficiently adjacent to each said intersection so as to be excited by ultraviolet radiation emitted from the gaseous discharge of each discharge unit and emit visible light of a brightness and intensity sufficient for visual display.

31. The invention of claim 30 wherein the photoluminescent phosphors are on said dielectric material surface at each discharge unit in direct contact with said gaseous medium.

* * * * *